US010624447B1

(12) United States Patent
Manning

(10) Patent No.: US 10,624,447 B1
(45) Date of Patent: Apr. 21, 2020

(54) POWER DRIVEN DUSTER AND CLEANER APPARATUS

(71) Applicant: CROWN DOWN CLEANERS, L.L.C., Gonzales, LA (US)

(72) Inventor: Paul D. Manning, Gonzales, LA (US)

(73) Assignee: CROWN DOWN CLEANERS, LLC, Gonzales, LA (US)

( * ) Notice: Subject to any disclaimer, the term of this patent is extended or adjusted under 35 U.S.C. 154(b) by 269 days.

(21) Appl. No.: 15/710,034

(22) Filed: Sep. 20, 2017

Related U.S. Application Data

(60) Provisional application No. 62/398,195, filed on Sep. 22, 2016.

(51) Int. Cl.
*A46B 13/02* (2006.01)
*A46B 13/00* (2006.01)
*A47L 13/38* (2006.01)

(52) U.S. Cl.
CPC ..... *A46B 13/02* (2013.01); *A46B 13/001* (2013.01); *A46B 2200/3026* (2013.01); *A46B 2200/3086* (2013.01); *A47L 13/38* (2013.01)

(58) Field of Classification Search
CPC ..... A46B 13/02; A46B 13/001; A46B 15/23; A46B 15/28; A46B 13/01; A46B 13/08; A46B 2200/3026; B25B 15/001; B25B 15/004; B25B 15/005
USPC ..... 15/144.4; 81/177.1, 489
See application file for complete search history.

(56) References Cited

U.S. PATENT DOCUMENTS 4,352,485 A * 10/1982 Basey ..... E04F 11/1834 256/22
4,653,142 A * 3/1987 Upton ..... A47L 13/24 15/144.4
5,502,864 A * 4/1996 Sorenson ..... B05C 17/0205 15/144.4
5,983,455 A * 11/1999 Polzin ..... B05C 17/0205 15/144.4
6,295,681 B1 * 10/2001 Dolah ..... A46B 13/001 15/101
6,374,446 B1 * 4/2002 Gleason ..... A46B 13/001 15/23

(Continued)

*Primary Examiner* — Randall E Chin
(74) *Attorney, Agent, or Firm* — Roy Kiesel Ford Doody & North, APLC

(57) ABSTRACT

An improved hand held apparatus used for dusting, cleaning, polishing, and similar tasks utilizing a lightweight conventional power drill having a rotating axle with a chuck to which is attached one or more elongated extension members telescoped within one another and fixed relative to one another by a clamping connector, the first extension member having a first connecting member at one end constructed to be inserted into and attachable to the chuck and a second member at the opposing end of the extension members constructed to be attachable to the head of a conventional dusting device. The apparatus further includes a foam covered tubular hand guide member fitted about the first extension member and constructed to slide along the first extension member. The first connecting member is constructed having a shield to prevent water from dripping down the extension members and into the power drill, and to prevent the guide member from sliding off the extension member when the extension member is not attached to the power drill.

13 Claims, 6 Drawing Sheets

(56) References Cited

U.S. PATENT DOCUMENTS

| | | | | |
|---|---|---|---|---|
| 7,237,305 | B2 * | 7/2007 | Newman | B25B 13/48 15/144.4 |
| 7,331,077 | B1 * | 2/2008 | Henry | A46B 5/0033 15/23 |
| 7,997,169 | B1 * | 8/2011 | Hack | B25B 13/06 81/177.2 |
| 2008/0168629 | A1 * | 7/2008 | Touchette | B25D 1/14 16/430 |
| 2009/0249569 | A1 * | 10/2009 | Schouten | A47L 13/23 15/144.4 |
| 2013/0326832 | A1 * | 12/2013 | Resh | B25G 1/04 15/144.4 |
| 2014/0237742 | A1 * | 8/2014 | Manning | A47L 13/38 15/97.1 |
| 2014/0310897 | A1 * | 10/2014 | Higgins | B24D 13/045 15/97.3 |
| 2015/0101177 | A1 * | 4/2015 | Hall | B23B 51/08 29/525.11 |

* cited by examiner

POWER DRIVEN DUSTER AND CLEANER APPARATUS

BACKGROUND OF THE INVENTION

Field of the Invention

This invention relates in general to apparatus for dusting, cleaning, polishing, and other similar tasks, and more particular to a power driven apparatus for dusting, cleaning, or polishing.

Prior Art

The dusting and cleaning of homes, commercial office building or other similar structures has provided the commercial and residential cleaning industry with many challenging dusting or cleaning issues. One such issue is removing easily and efficiently the dust from narrow ledges, such as floor molding, wainscoting, crown molding, and other similar structures so that it can be vacuumed and removed from the building. Other such difficult dusting structures would include various crevices and corner areas common in these structures. Also three-dimensional decorative areas in furniture contained in these structures or on the edge of paintings, tapestries or other wall mounted art objects are further examples of problem areas. It was necessary to use rags or other cloth materials to hand rub these dust catching areas. This is a very time consuming process that in many cases achieves unsatisfactory results. Another time consuming situation occurs when dusting table or desk surfaces having various small objects positioned on the surfaces. In such situations it necessary to either remove or otherwise secure the objects before the surfaces are dusted in order to avoid breakage of the objects or knocking them to the floor.

Safety and other issues arise when trying to dust areas that are above the reach of the cleaning person that requires the person to climb a ladder to reach the areas, or near the floor that requires the cleaning person to stoop or get on their knees to reach the areas. In addition to the safety issues, the dusting process is very time consuming and fatiguing to the person cleaning these areas. This is particularly true when the person uses dusting devices affixed at one end to an extension pole.

It would also be beneficial to the cleaning industry if a device was constructed that not only dusted, but could also be utilized to polish or clean the structure or perform similar tasks. Another beneficial feature for a device needed by the cleaning industry would be the ability not only to dust, but also to clean a wide variety of surfaces so as to service multi-purpose functions. A still further beneficial feature would be the ability to utilize the device around electrical outlets or to dust and clean electrical components of equipment while minimizing the risk of shocking the person utilizing the device. Another beneficial feature would be the ability to utilize the device to also clean exterior surfaces such as concrete driveways or car rims or similar surfaces. It would be further beneficial if the device could be utilized not only to clean interior surfaces, but also exterior surfaces in both wet and dry conditions.

These prior problems were addressed by the power driven duster and cleaning apparatus described in U.S. Pat. No. 8,984,695 filed by the inventor herein. In this device the motorized hand held apparatus was constructed having a tubular extension member affixed at one end to a conventional lightweight hand drill and having a dusting member affixed to the opposite end of the tubular member whereby when the hand held power drill is powered the dusting member will rotate. In this device better balance, control and ease of use is achieved by providing a guide member that can be gripped by one hand of the operator and slid up and down the tubular member while the operator utilizes his opposite hand to operate the drill motor. Although this device provided distinct advantages over the known prior art there remained several problems.

If these prior art devices are operated in wet conditions, water can drip down the tubular member and into the drill motor causing the motor to short or be otherwise damaged. These prior art devices still have protruding parts and sharp edges that can snag the operator's clothing or injure the operator. Still further, after use these devices are difficult to break apart for compact storage or when it is desirable to change the dusting member. Also, when the extension member is disconnected from the power drill, the sliding hand guide member is able to slide off the tubular extension member and can become lost or require its separate storage space. Still another problem is that prolonged gripping of the hand guide member during operation of the duster and cleaning device causes hand fatigue resulting in less efficient cleaning.

OBJECTS OF THE INVENTION

It is object of this invention to overcome one or more of the above identified prior art problems.

More specifically, it is an object of this invention to provide means to prevent the hand guide member from sliding off of the tubular extension member when disconnected from the power drill.

It is a further object of this invention to permit the dusting/cleaning member to be quickly attached or detached from the tubular extension member.

It is a still further object of this invention to provide a dusting/cleaning member that is constructed to hold additional water when used as a cleaning member.

It is an additional object of this invention to provide a dusting/cleaning member with a lint-free head.

It is also an object of this invention to construct the various elements of the invention to have no projections or sharp edges to snag the operator's clothing or injure the operator during use of the dusting and cleaning device.

It is still another object of this invention to provide means preventing water running down the extension member(s) from dripping into the power drill.

It is another object of this invention to provide a connection of the brush head to the extension members of the cleaning apparatus to prevent the brush head from wobbling during operation of the cleaning apparatus.

These and other objects and advantages of the invention will become apparent from the following description of the preferred embodiments of the invention.

SUMMARY OF THE INVENTION

According in a hand held apparatus for dusting, cleaning, polishing, and/or similar task having an elongated extension member operatively attachable at one end to a chuck of a lightweight conventional power drill causing the extension member to rotate when the drill is activated and having a dusting, cleaning, polishing, and/or similar task member attachable to an opposite end of the extension member to rotate in synchronization with the elongated extension member, and having a tubular hand guide member constructed to fit about and to slide along the elongated extension member, the improvement to which comprises an attachment member connecting the power drill to the extension member, the attachment member having (i) a cylindrical barrel-shaped body constructed to be securely fitted into the elongated extension member open end, (ii) a circular shield affixed to one end of the barrel and having a diameter larger than the diameter of the barrel and larger than the diameter of the elongated extension member whereby the perimeter area of the shield extends outward from the barrel surface a sufficient distance to act as a stop to prevent the tubular hand guide member from sliding off the elongated extension member and to prevent water dripping down the elongated extension member from entering into the power drill, and (iii) a generally rod shaped member sized to fit into and securely held by the power drill chuck.

In a preferred embodiment the tubular hand guide member is provided with an outer resilient and compressible coating constructed of foam, rubber, plastic or other compressible material to cushion the operator's hand when gripping the tubular guide member.

In another preferred embodiment the apparatus includes one or more elongated extension members telescoped into the first elongated extension member affixed to the attachment member. To minimize or eliminate any wobble of the spinning cleaning head during operation, it is preferred that the tolerance between the adjacent interior and exterior surfaces of the extension members be less than about 2 mm, and more preferably about 0.5-1.5 mm. When the second elongated extension member is telescoped out of the first elongated extension member to a desired position, the second elongated extension member is fixed in position by a two piece securing means that when treaded together clamp to the second elongated extension member to prevent further linear movement of the second elongated extension member and to ensure that during operation the spinning second extension member is synchronized with the first extension member and its elongated end does not wobble. In a more preferred embodiment the outside diameter of the securing means is sufficiently greater than the diameter of the first elongated extension member so as to act as a stop to prevent the hand guide means from sliding off the first elongated extension member. In a still more preferred embodiment the first piece of the two-piece securing means has a hollow tubular body shaped to fit snug over the exterior surface area at the extending end of the first elongated extension member. If desired, additional rivets may be used to further affix the hollow tubular body to the exterior surface area of the first elongated extension member. The first piece is constructed to have clamping finger members extending over and around the second elongated extension member protruding from the end of the first elongated extension member. The finger member have a flexible section connecting to the first piece body and a series of rigid pressure plate sections extending outward from the flexible section. The pressure plate sections have an arc shaped cross-section that is thicker at the area affixed to the flexible section and thinner at its outer edge. In this configuration when the second elongated member is slid over the finger members, the pressure plate sections of the finger members exert pressure against the outer surface of the second elongated extension member. To fix and increase this pressure the second piece of the securing means is a tubular member having a forward section having interior threads that can be screwed onto the exterior threads of the first piece body. The second piece also has a rear section that is angled to form an increasing narrow interior cross-section that results in the pressure plates pressing harder on the second extension member as the rear section is screwed onto the first extension member exterior threads further securing the second elongated tubular member in position. When it is desired to move the second elongated tubular member, one only needs to unscrew the second piece of the securing means from the first piece of the securing means.

In another preferred embodiment a threaded shaft is crimped or otherwise affixed to the protruding end of the second elongated tubular member. The treaded section of the shaft is designed to extend into the interior passageway in the handle of the dusting/cleaning head and mate with the threads on an interior surface of the interior passage4way. The treaded sections are constructed so they mate by screwing in the same direction of the rotation of the elongated tubular member. In this manner the operation of the device will not disconnect the dusting/cleaning head from the elongated tubular members.

A typical dusting/cleaning head is constructed by affixing a multitude of bundled soft fibers to a central shaft extending axially from the dusting/cleaning head handle. In a preferred embodiment the bundles affixed closest to the end section of the handle are constructed to contain at least 25% more fibers per bundle. It has been found that this configuration of bundles results in the head being able to retain more water to the cleaning operation utilizing the device of this invention.

The foregoing has outlined rather broadly the features and technical advantages of the present invention in order that the detailed description of the invention that follows may be understood. Additional features and advantages of the invention will be described hereinafter which form the subject of the claims of the invention. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings, sketches and photographs of a prototype of the invention illustrate preferred embodiments of this invention. However, it is to be understood that these embodiments are not intended to be exhaustive, nor limiting of the invention. They are but examples of the construction of this invention.

PREFERRED EMBODIMENTS OF THE INVENTION

Without any intent to limit the scope of this invention, reference is made to the figures and following description of the preferred embodiments of the invention.

For purposes herein the term "dusting" when referring to a task also includes the tasks of cleaning and/or polishing. Thus, phrases such as "dusting apparatus" includes an apparatus that is involved with dusting, cleaning, and/or polishing tasks.

Figure 1:
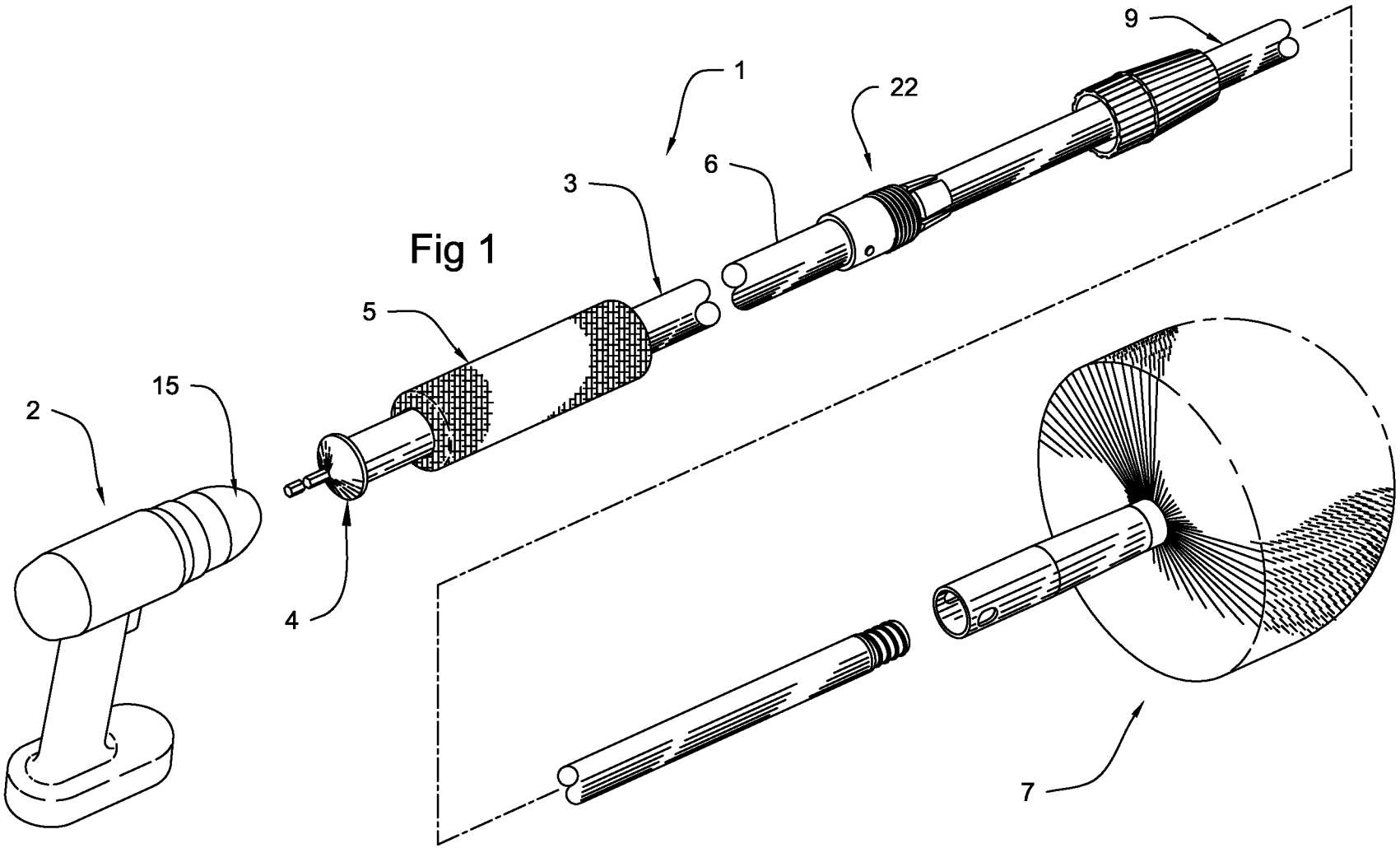
FIG. 1 an exploded perspective view of the dusting/cleaning apparatus of this invention including a power drill, an initial extension member having one end attachable to power drill by a novel first connecting assembly and an opposite end through which a second extension member can extend and be fixed in position by a novel second connecting assembly wherein the extending end of the second extension member has a connecting member attachable to the dusting/cleaning member.

Referring now to FIG. 1, the hand held dusting apparatus 1 of this invention includes a conventional cordless, light weight, low rpm, reversible electric drill 2 attachable to at least one elongated, tubular extension member 3 by first connecting assembly 4. The first connecting assembly 4 is constructed to perform multiple functions. In addition to its function of attaching drill 2 to tubular extension member 3, it also is constructed to act as a stop to prevent tubular hand guide member 5 that slides axially up and down on the exterior surface 6 of elongated tubular extension member 3 from sliding off extension member 3 when the electric drill 2 has been detached from the extension member 3. In addition first connection assembly 4 is also constructed to reduce or prevent water on the exterior surface 6 from dripping into the electric drill 2 during operation of the cleaning/dusting/polishing procedure. The apparatus 1 of this invention further includes a cleaning/dusting/polishing head 7 that is attachable to the one or more elongated tubular extension members 3.

The number of elongated extension members 3 that are utilized depends on the need to extend the position of dusting head 7 to the area to be dusted or cleaned. Preferably, each member 3 is 2-3 feet in length, although greater lengths can be used. The construction of each member 3 should result in a member that is sufficiently rigid not to bend during its rotation and as lightweight as possible to reduce operator arm fatigue during its use. It is also preferred that each extension member 3 be both hollow and tubular in shape and having a passageway 8 extending axially along its length to not only decreases the weight of extension member 3, but also sized to permit a second extension member 9 to be telescoped into and out of the passageway 8. It is also preferred that both extension members 3 and 9 be constructed of light weight material such as aluminum or rigid plastic, and more preferably of a material that is non-conducting of electricity. In an alternate embodiment more than two extension members can be utilized in the construction of dusting apparatus 1.

Figure 2:
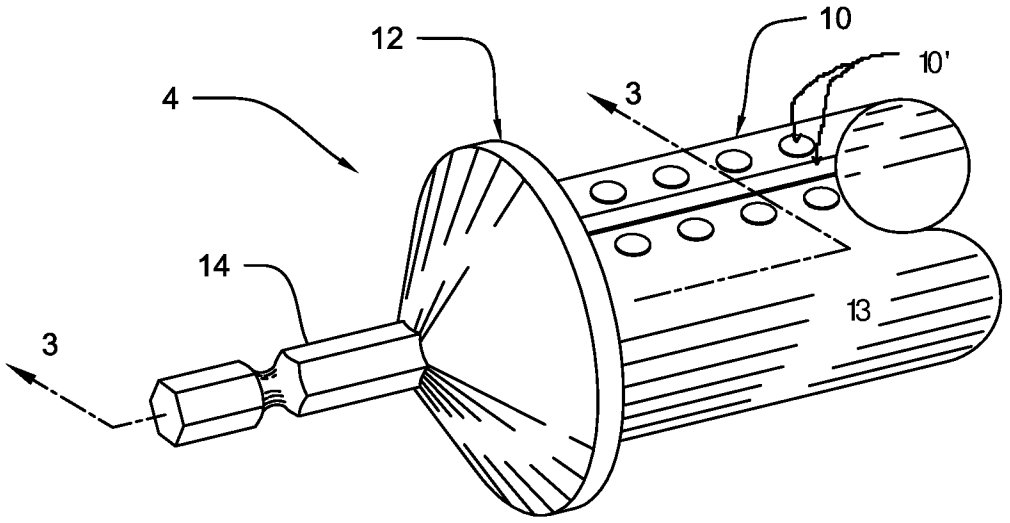
FIG. 2 is a three-quarter perspective view of the first connecting assembly including a hexagonal cross-sectional shaped rod member to connect to the quick release chuck of the power drill, a cylindrical-shaped base member to attach to the initial extension member, and a rounded pyramid or cone shaped shield.
Figure 3:
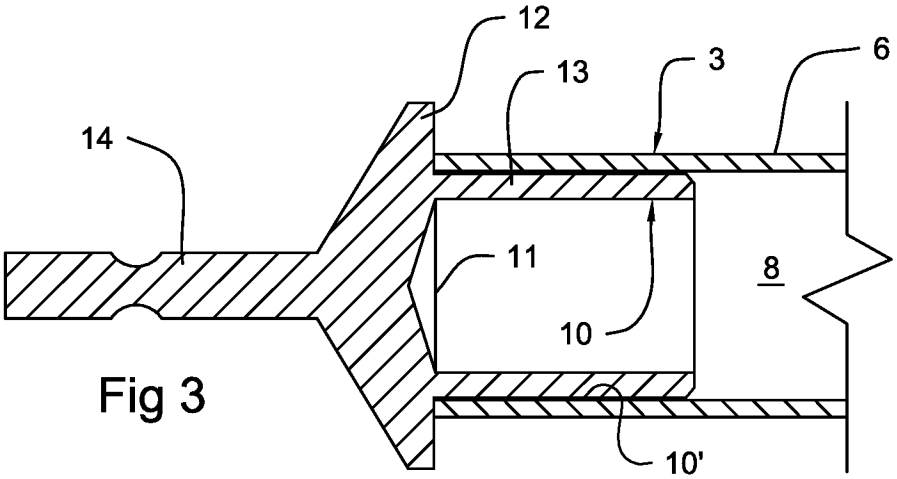
FIG. 3 is a cross-sectional view taken along lines 3-3 of FIG. 2.

As illustrated in FIGS. 2 and 3 the first connecting assembly 4 is constructed having a cylindrical barrel-shaped body 10 sized to be securely fitted into one end 11 of passageway 8 of extension member 3. The body 10 can be securely fitted in passageway 8 by gluing, crimping, riveting, screwing, welding or other known similar securing means. In various embodiments, the cylindrical-shaped body 10 includes an exterior surface 13 constructed having a series of raised areas 10' to facilitate gluing or otherwise affixing the cylindrical-shaped body 10 of the first connecting assembly 4 to an interior surface area of the elongated, tubular extension member 3. The connecting assembly 4 further comprises a circular shield 12 affixed to one end of the barrel-shaped body 10. The shield 12 has a diameter larger than the diameter of the barrel shaped body 10, as well as larger than the diameter of the extension member 3 whereby the perimeter area of the shield 12 extends outward from the barrel-shaped body exterior surface 13 a sufficient distance to act as a stop to prevent the hand guide 5 from sliding off extension member 3 and to prevent water dripping down the extension member 3 from entering into the electric drill 2. Protruding axially from body 10 is generally rod-shaped shaft 14 sized to fit into and securely held by the power drill chuck 15.

Figure 4:
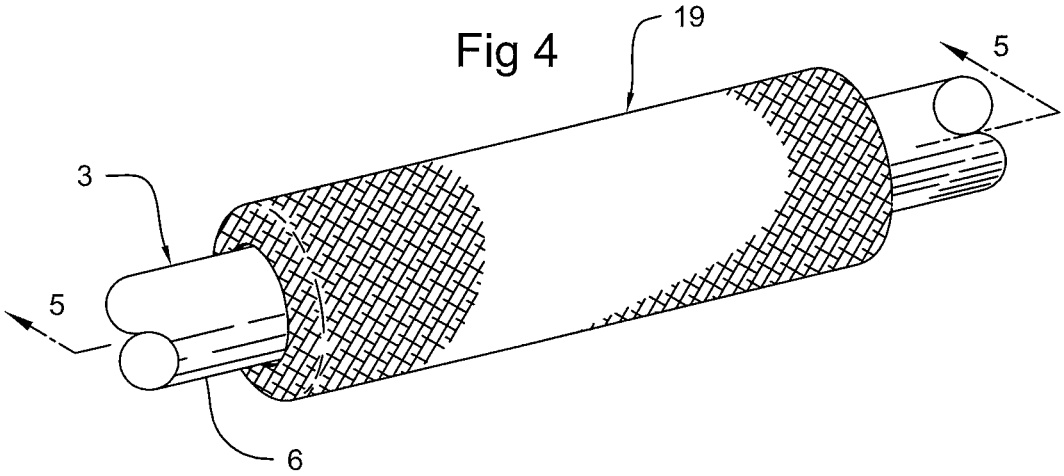
FIG. 4 is a three-quarter perspective view of the hand guide illustrating the tubular member having a passageway permitting the hand guide to slide along the first extension member and provided with an outer coating made from foam, rubber or other resilient and compressible material.
Figure 5:
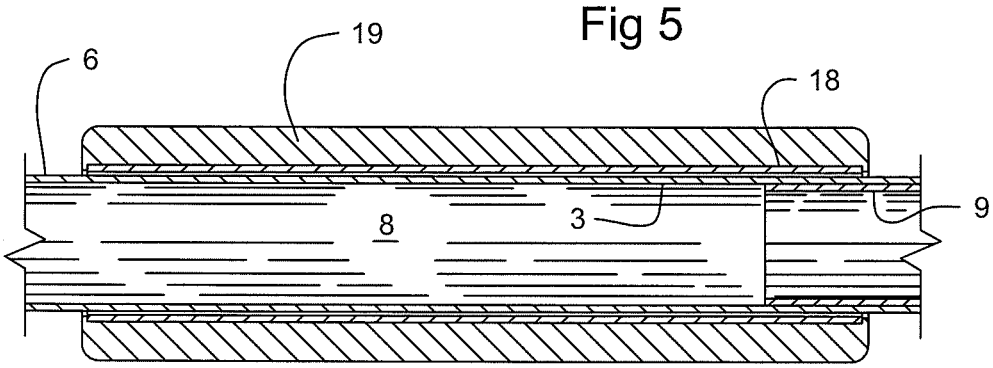
FIG. 5 is a cross-sectional view taken along lines 5-5 of FIG. 4.
Figure 6:
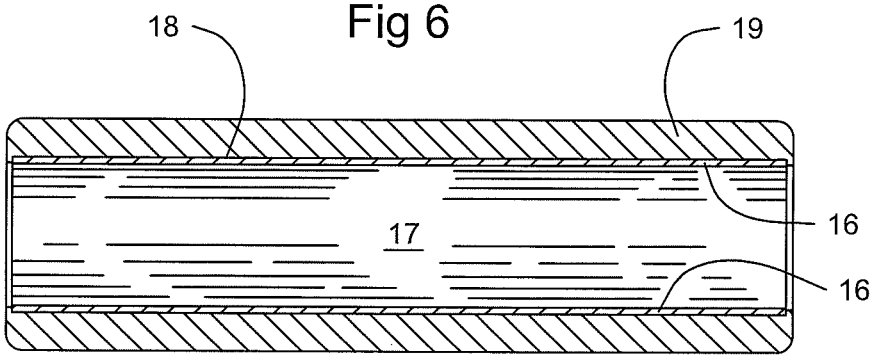
FIG. 6 is a cross-sectional view of the hand guide comprising a rigid, hollow tubing forming a passageway sized to permit the guide to slide over the surface of the elongated extension members and further comprising an outer coating of resilient and compressible material extending over and affixed to the rigid interior tubing.
Figure 7:
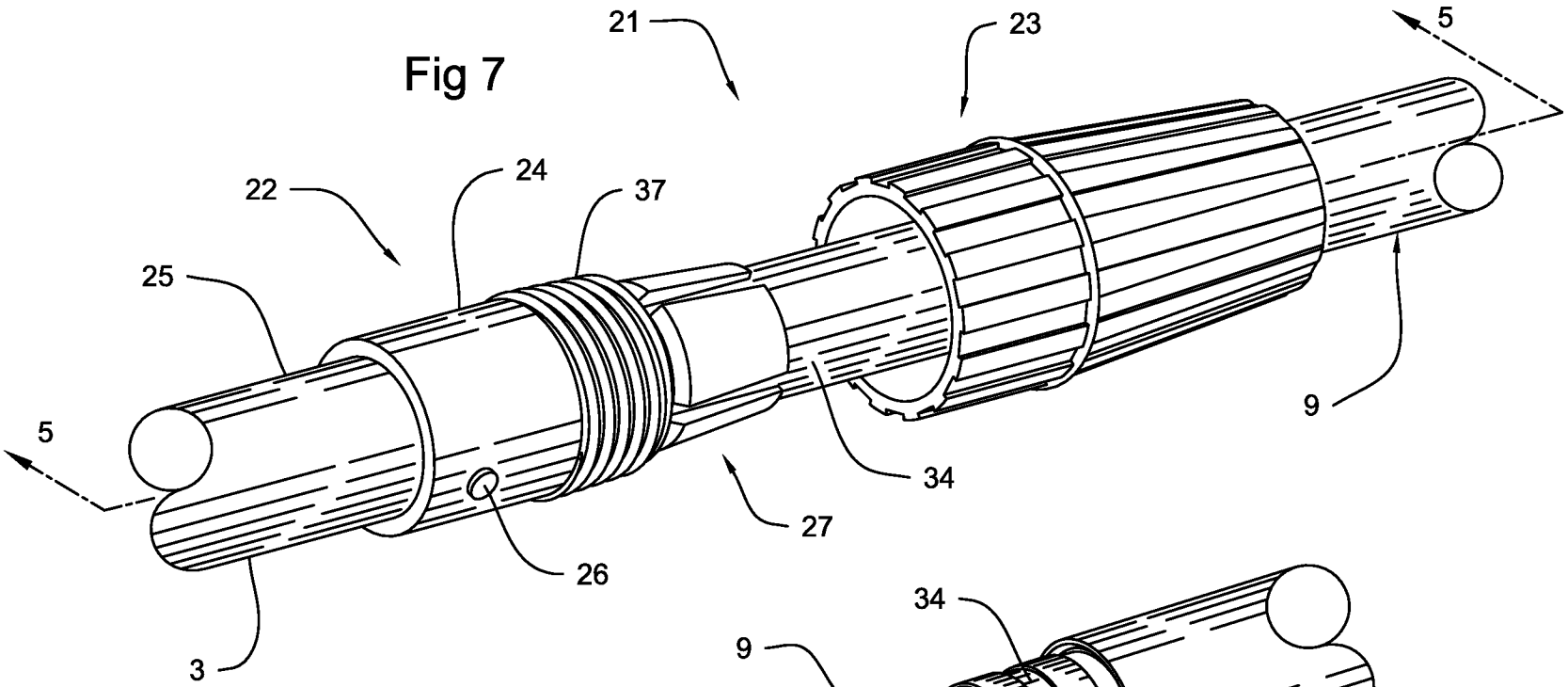
FIG. 7 is a three-quarter, exploded perspective view of a second connecting assembly used to fix the second extension member in the desired position extending from the first extension member.

FIGS. 4-6 illustrate a preferred embodiment of hand guide 5. Hand guide 5 includes a rigid hollow tube 16 provided with an axial passageway 17 sized to permit hand guide 5 to slide along the exterior surface 6 of extension member 3. Coating the exterior surface 18 of tube 16 is a resilient and compressible material 19, such as foam, rubber, soft plastic or similar material to cushion the operator's hand when gripping hand guide 5 for long periods of time.

FIGS. 7-10 illustrate a preferred means to fix the position of the second extension member 9 when it is partially extended out of the second end 20 of passageway 8 of the first extension member 3. This means includes a two-piece securing device 21 that when threaded together clamp down on the second extension member 9 to prevent further movement of the second extension member 9. In a more preferred embodiment the outside diameter of at least one of the two pieces 22, 23 is sufficiently greater than the outside diameter of the first extension member 3 so as to act as a stop to prevent the hand guide 5 from sliding off first extension member 3.

In a more preferred embodiment the first piece 22 is constructed having a hollow tubular body 24 shaped to fit snug over the exterior surface area 25 forming second passageway end 20 of first extension member 3. If desired additional rivets 26 can be used to further affix the hollow tubular body 24 to the exterior surface of extension member 3. The first piece 22 is further constructed to have multiple finger members 27. Finger members 27 include a flexible section 29 extending out from the end surface 30 of body 24. Finger members 27 also include pressure plates 31 extending from flexible section 29. Each pressure plate 31 is thicker at its base end 32 extending from flexible section 29 than at its forward section 33. Pressure plates 31 extend over and press down on the exterior surface area 34 of second extension member 9 protruding from passageway second end 20 of first extension member 3. In this configuration when the second extension member 9 slides past finger members 27, pressure plates 31 exert pressure against the exterior surface 34 of extension member 9. To fix and increase this pressure the second piece 23 is constructed as a tubular member having a decreasing interior diameter at its extending end section 35 provided with interior threads 36 that can be screwed onto the exterior threads 37 on exterior surface 38 of body 24 when pieces 22 and 23 are screwed together. The decreased interior diameter surface 39 presses onto the pressure plates 31 further securing the second extension member 9 in position.

Figure 8:
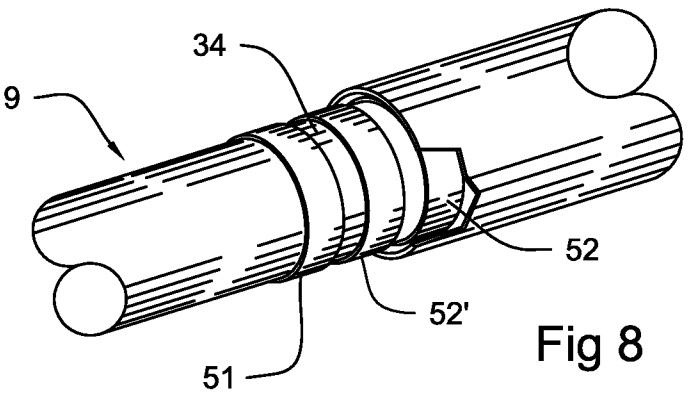
FIG. 8 is a three-quarter view of the extension member having two spaced apart plastic bands snugly fitted to the outer surface of the second extension member and which fit into the gap formed between the inner surface of the first extension member and the outer surface of the second extension member.
Figure 9:
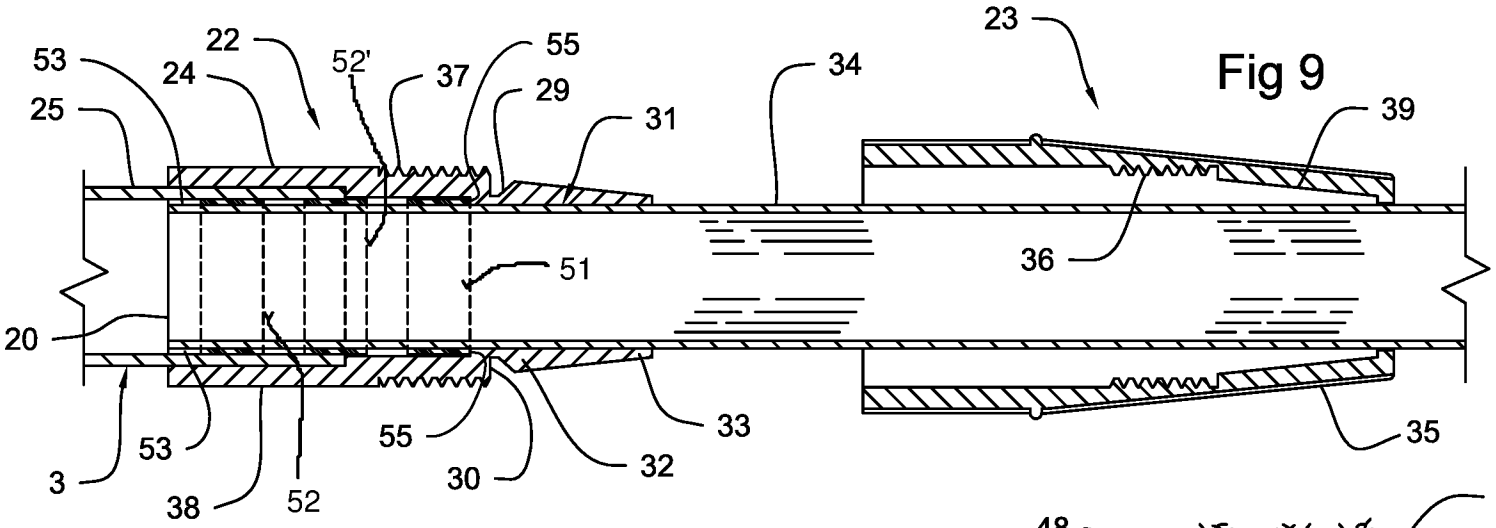
FIG. 9 is a cross-sectional view taken along lines 8-8 of FIG. 7.
Figure 10:
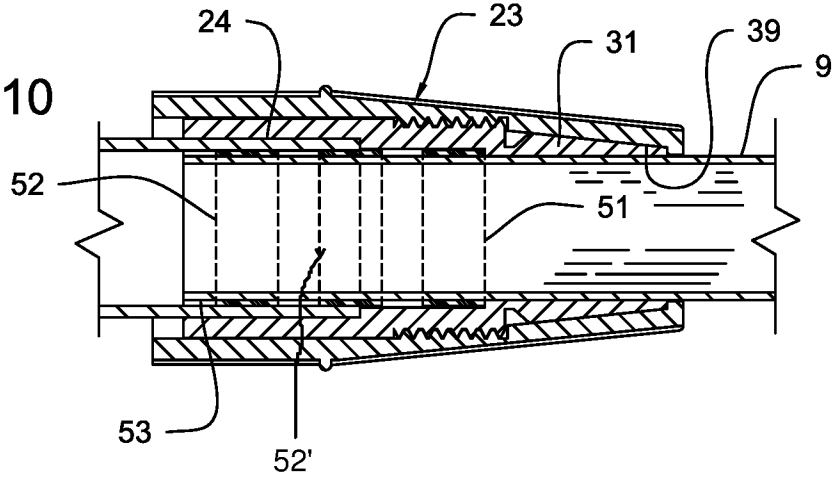
FIG. 10 is a cross-sectional view taken along lines 9-9 of FIG. 7 when second piece is screwed on the first piece causing the interior surface of the second piece to press down on the pressure plates of the fingers members.

As seen more clearly in FIGS. 8-10, extension member 9 is constructed having two, spaced-apart bands 51, 52 snugly affixed to the exterior surface 34 of extension member 9. Both bands 51, 52 are sized to fit into gap 53 formed by the inner surface 54 of the first extension member 3 and exterior surface 34 of the second extension member 9. In a preferred embodiment the bands 51, 52 are constructed from a resilient material, and more preferably from plastic or rubber. These bands 51, 52 in their spaced-apart position, preferably 2-4 inches apart, provide stability to extension member 9 when it is extended out of extension member 3 and significantly reduces the wobble to dusting/cleaning head 7 during operation of the apparatus 1. If desired, more than two spaced-apart bands can be utilized. Band 51, in conjunction with the shoulder section 55 of first piece 22 extending downward into gap 53, form a stop preventing extension member 9 from being extended more than a predetermined distance out of extension member 3. In the event band 51 fails, then band 52 acts as a safety back up to band 51 to keep extension member 9 from being extended completely out of extension member 3.

Figure 12:
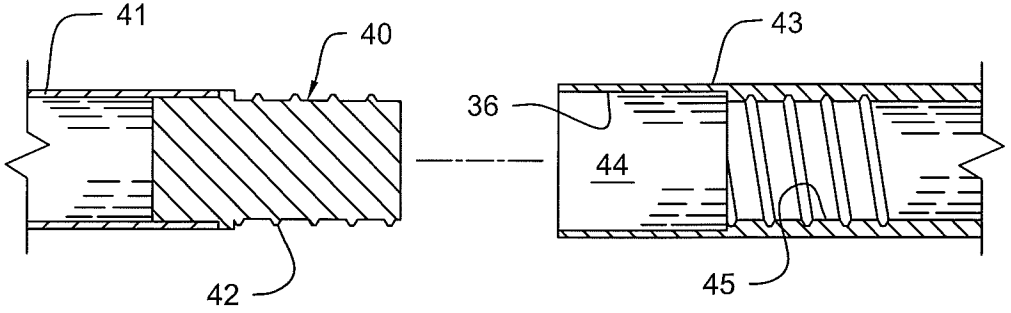
FIG. 12 is a cross-sectional view taken along lines 11-11 of FIG. 10.
Figure 11:
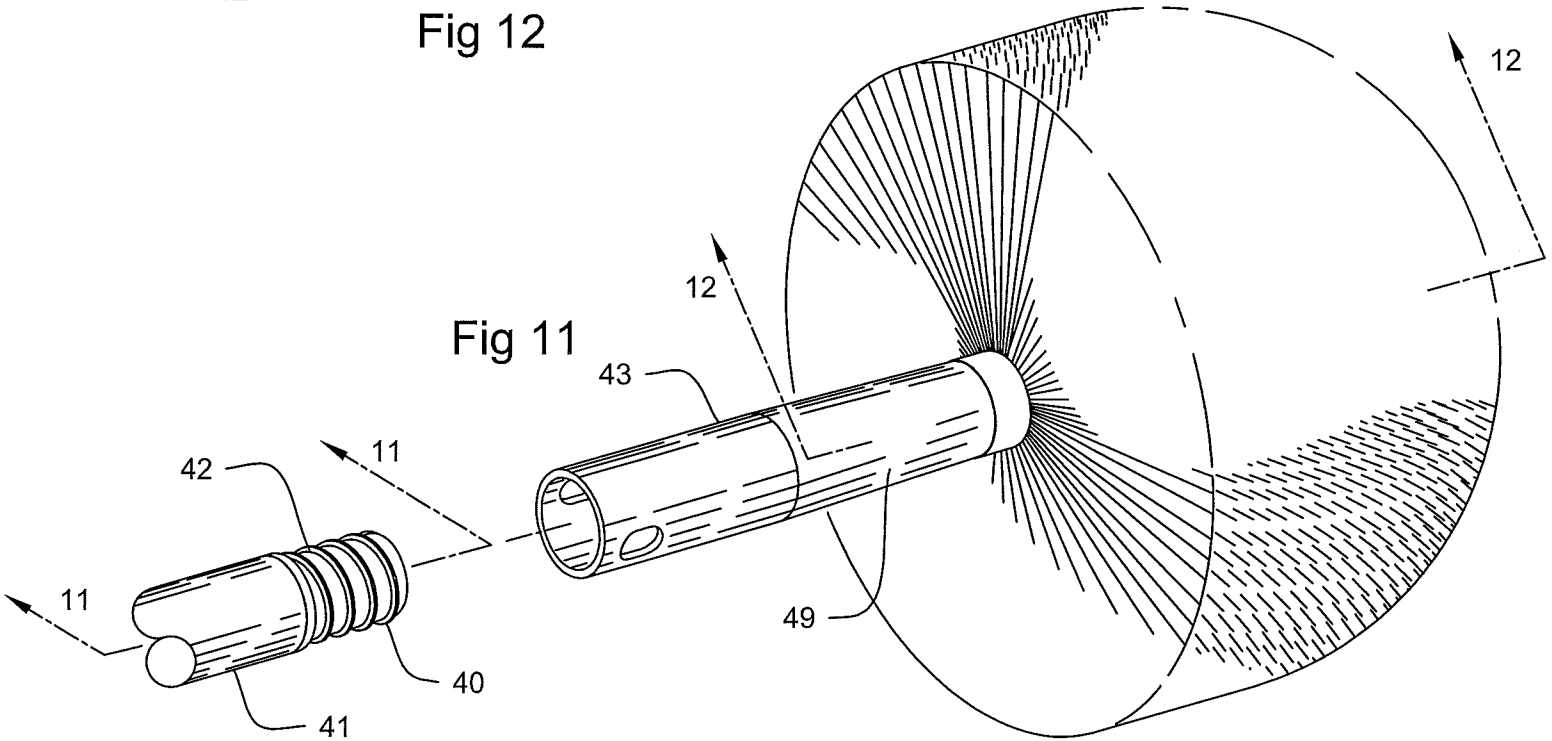
FIG. 11 is a three-quarter perspective view of the extending threaded end of the second elongated member positioned to being screwed into the hollow shaft of the dusting/cleaning head.

In another preferred embodiment as illustrated in FIGS. 11 and 12 a threaded shaft 40 is crimped or otherwise affixed to the protruding end 41 of the second extension member 9. Threaded section 42 of shaft 40 is constructed to extend into hollow handle 43 of head 7 and mate with threads 45 position on the interior surface section 46 of handle cavity 44. Preferably, the treaded sections 42 and 44 are constructed to mate by screwing in the same direction as the rotation of first and second extension members 3 and 9. In this manner the operation of apparatus 1 will not disconnect the dusting head 7 from the extension members 3 and 9.

Figure 13:
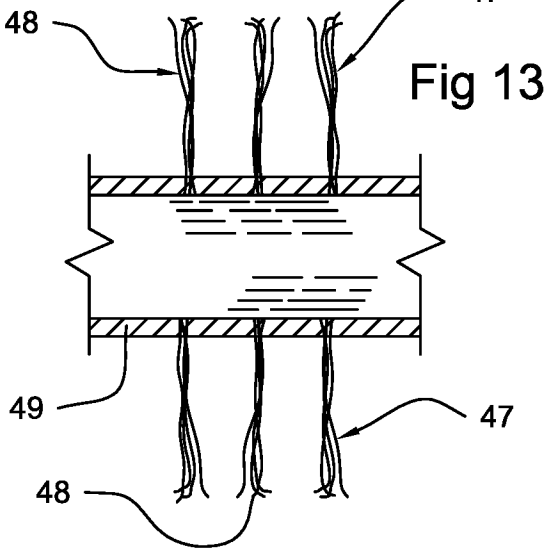
FIG. 13 is a cross-sectional view taken along lines 12-12 of FIG. 10 illustrating the positioning of the bundles of fibers about the handle shaft.

As illustrated in FIG. 13, a typical dusting head 7 is constructed by affixing a multitude of bundles 47 of soft fibers 48 to a central shaft 49 extending axially from the handle 43. In a preferred embodiment the bundles 47 affixed to closest portions of end section 50 of handle 43 are constructed to contain at 25% more fibers per bundle 47. It has been found that this configuration of bundles 47 results in dusting head 7 being able to retain more water during the cleaning operation of apparatus 1. It is further preferred that the fibers 48 contained in bundles 47 be constructed from a split-tipped soft poly fibers, and more preferably fibers that are 0.015625-0.0625 inches in diameter and 0.5-6.0 inches in length. In a still further preferred embodiment the fibers 48 have varying lengths and are attached to head 7 to form a generally bulbous shape such as illustrated in FIG. 12. In addition to the fibers 48 having multiple shapes, they can be constructed of other materials that may be more suitable to the surface being dusted, cleaned, or polished.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What I claim is:

1. A hand held apparatus for dusting having a first elongated tubular extension member operatively attachable at one end to a motor to cause the first elongated tubular extension member to rotate, a hand guide member constructed to fit about and to slide along the first elongated extension member; and a dusting member operatively attachable to an opposite end of the first elongated tubular extension member to rotate with the first elongated tubular extension member, the improvement to which comprises a first connecting assembly affixed at one end of the first elongated tubular extension member for operatively attaching the first elongated tubular extension member to the motor, the first connecting assembly comprising:

a. a rod-shaped shaft;

b. a cylindrical-shaped base member sized to extend into a hollow cavity at the one end of the first elongated tubular extension member; and c. a shield having a generally cone shape attached between the rod-shaped shaft and the base member, the shield extending outward beyond the exterior surfaces of the rod-shaped shaft and the base member a sufficient distance to prevent any water traveling down the first elongated tubular extension member from entering into the motor and to prevent the hand guide member from sliding off the first elongated tubular extension member when the motor is disconnected from the first elongated tubular extension member.

2. The hand held apparatus according to claim 1, wherein the rod is constructed having a circular groove to permit use of a quick connect device to operatively attach the rod to the motor.

3. The hand held apparatus according to claim 1, wherein the cylindrical-shaped based member of the first connecting assembly includes an exterior surface area constructed having a series of raised areas to facilitate securely fitting the base member to an interior surface area of the first elongated tubular extension member.

4. The hand held apparatus according to claim 1 wherein the shield perimeter extends beyond the surface of the base member a sufficient distance to maintain the hand guide member on the first elongated tubular extension member.

5. The hand held apparatus according to claim 4 wherein the shield perimeter extends about 0.25 inches to about 0.50 inches beyond the surface of the base member.

6. The hand held apparatus according to claim 4 wherein the shield perimeter is structured having rounded edges.

7. The hand held apparatus according to claim 1 wherein the hand guide member comprises a resilient, compressible outer coating to cushion an operator's hand when supporting the hand guide member during operation for long periods of time.

8. The hand held apparatus according to claim 1 further comprising a second elongated tubular extension connecting assembly affixed at the opposite end of the first elongated tubular extension member for operatively attaching the first elongated tubular extension member to the dusting member, wherein the second elongated tubular extension connecting assembly comprises:

a. a second elongated tubular extension member that extends at one end into the first elongated tubular extension member and protrudes at its opposite end out of the first elongated tubular extension member;

b. an affixing member structured to fit about the opposite end of the first elongated tubular extension member and the second elongated tubular extension member and to affix the first elongated tubular extension member to the second elongated tubular extension member, the affixing member having expandable finger members that extends partially down and in contact with an exterior surface of the second elongated tubular extension member, the affixing member further having a threaded section on its exterior surface; and c. a clamping member having a hollow tapered section with an interior threaded area sized to fit about affixing member and mate with the threaded area of the affixing member, the tapered section sized to press against expandable finger members to force the expandable finger members into pressing relationship against the exterior surface of the second elongated tubular extension member.

9. A hand held apparatus for dusting having a first elongated tubular extension member operatively attachable at one end to a motor to cause the first elongated tubular extension member to rotate, a hand guide member constructed to fit about and to slide along the first elongated tubular extension member; and a dusting member operatively attachable to an opposite end of the first elongated extension member, the dusting member rotating with the first elongated extension member, the improvement to which comprises:

a. a second elongated tubular extension member with a first and second end, the first end sized to telescope in and out of the first elongated tubular extension member, the second end attached to the dusting member to rotated with the first elongated extension member, wherein a gap is formed between overlapping sections of the first and second elongated tubular members;

b. a first band snugly fitted about the first end of the second elongated tubular extension member and sized to permit the at least one band to fit into the gap, the first band providing stability to the second extension member with respect to the first extension member to reduce wobble in the second extension member when the motor causes the first extension member to rotate;

c. an affixing member structured to fit about the first elongated tubular extension member and the second elongated tubular extension member to affix the first elongated tubular extension member to the second elongated tubular extension member; the affixing member having a shoulder section extending into the gap and together with the first band to form a stop allowing the second elongated tubular extension member to extend from the first elongated tubular extension member no more than a predetermined distance.

10. A hand held apparatus for dusting according to claim 9, further comprising a second band snugly fitted on the first end of the second elongated extension member, sized to permit the second band to fit into the gap and spaced apart from the first band, the second band providing stability to the second extension member with respect to the first extension member to reduce wobble in the second extension member when the motor causes the first extension member to rotate.

11. A hand held apparatus for dusting according to claim 10 wherein the second band is spaced apart from the at least one band about 2-4 inches.

12. A hand held apparatus for dusting according to claim 10 wherein the first band and the second band are constructed from a resilient material.

13. A hand held apparatus for dusting according to claim 10 having more than two bands snuggly fitted on the first end of the second elongated extension member, each band spaced apart from any adjacent band by about 2-4 inches and sized to permit each band to fit into the gap providing stability to the second extension member with respect to the first extension member to reduce wobble in the second extension member when the motor causes the first extension member to rotate.

* * * * *